United States Patent [19]

Evans et al.

[11] 3,980,851

[45] Sept. 14, 1976

[54] HIGH AMPERAGE SWITCHING APPARATUS WITH BI-METALLIC ARCING CONTACTS

[75] Inventors: Leo G. Evans, Tonawanda; Michael B. Bykowski, Eggertsville, both of N.Y.

[73] Assignee: Hooker Chemicals & Plastics Corporation, Niagara Falls, N.Y.

[22] Filed: Aug. 1, 1974

[21] Appl. No.: 493,940

[52] U.S. Cl. ..... 200/146 R; 200/266; 200/289

[51] Int. Cl.[2] ..... H01H 33/12

[58] Field of Search ..... 200/146 R, 266, 289

[56] References Cited

UNITED STATES PATENTS

| | | | |
|---|---|---|---|
| 592,497 | 10/1897 | Scott | 200/146 A |
| 3,381,105 | 4/1968 | Mortenson | 200/266 |
| 3,649,790 | 3/1972 | Friedrich et al. | 200/146 R |
| 3,787,651 | 1/1974 | Chabala et al. | 200/146 R |

FOREIGN PATENTS OR APPLICATIONS

| | | | |
|---|---|---|---|
| 1,163,938 | 2/1964 | Germany | 200/289 |

*Primary Examiner*—Robert S. Macon
*Attorney, Agent, or Firm*—Peter F. Casella; Herbert W. Mylius

[57] ABSTRACT

In a high amperage switching apparatus comprising multiple, spaced apart, stationary first terminals, each in interruptable circuit communication with corresponding multiple, spaced apart, stationary second terminals, said communication being by movable knife type circuit interrupting means pivotably attached to each second terminal such that it will contact the corresponding first terminal at some point in the pivot arc, the improvement comprising removably and conductively attaching to at least one stationary first terminal, at least one primary sacrificial, bimetallic contact, having highly conductive lower attachment section and highly resistant contact tip and removably and conductively attaching to at least one corresponding movable circuit interrupting means at least one secondary sacrificial bimetallic contact, being comprised of multiple laminate highly conductive metal fingers backed by a spring, compression laminate, having a high resistant metal tip, said primary and secondary sacrificial bimetallic contacts being so attached to said first terminal and interrupting means that under high amperage current, when closing said switch, contact is made between the resistant tips of said primary and secondary sacrificial contacts prior to the initiation of arcing between the first terminal and the movable interrupting means, contact between the sacrificial contacts being maintained throughout the closing of the switch and when opening said switch, contact is maintained between the primary and secondary sacrificial contacts until the interrupting means is so far removed fro the first terminal that arcing therebetween may not occur.

10 Claims, 6 Drawing Figures

HIGH AMPERAGE SWITCHING APPARATUS WITH BI-METALLIC ARCING CONTACTS

BACKGROUND OF THE INVENTION

The present invention relates to a novel high amperage electric switching or shunting apparatus. More particularly, it concerns a high amperage switching or shunting apparatus fitted with easily replaceable highly resistant sacrificial contacts and a fluid cooling system which makes it especially adaptable for use under high amperage loads in a corrosive atmosphere of the type commonly found in close proximity to electrolytic cells used in the production of chlorine and caustic soda.

Chlorine and caustic soda are most commonly produced by electrolysis of sodium chloride brine. The constructional features of this special apparatus employed for this process vary, however, such apparatus share a common feature in that they all require the usage of electric current. The vast majority of chlorine and caustic soda manufactured today is produced by a process utilizing electrolytic cells. In practice, a plurality of cells of a given type, often as many as 100 or more, are usually physically located in a confined area (called a cell room) and electrically connected in series. The resultant electrical arrangement of cells is commonly referred to as a "circuit".

From a commercial standpoint, it is desired to operate the cell circuit in a continuous and uninterrupted manner. The shut-down of the totality of cells, in a cell room, or a line or connected cells is a complex operation which is prohibitive in both time and economics. This means that when an individual cell in the circuit begins to exhibit undesirable operational characteristics it must be repaired or removed from the circuit in a minimum of elapsed time. To accomplish this, it is common practice to shunt the current from the concerned cell so as to remove it from the circuit for repair.

With low amperage electrolytic cells, i.e., those operating at about 50,000 to 60,000 amperes, it has been common practice to employ simple knife type air-cooled shunt switches for this purpose. However, the recent trend in chlorine and caustic production has seen the introduction of new cell designs which are capable of operating at extremely high amperage levels, e.g., amperages of 90,000 to 150,000 amps and higher. Unfortunately, conventional air cooled shunts and knife switches do not perform satisfactorily when used to shunt such high currents. The intensity of the current level creates a momentary arc between the movable arm of the knife switch and the stationary terminal contacting therewith prior to the opening and closing of the switch which welds, pits and otherwise deteriorates these parts so that their life expectancy is significantly decreased and the obtaining of an efficient contacting surface is no longer possible. As the stationary terminal and movable arm of such switches are made of highly conductive and rather expensive material, the replacing of these positive parts becomes expensive and time consuming.

Accordingly, it is the principle object of the present invention to provide a high amperage electrical switching apparatus which is capable of operating satisfactorily in a corrosive environment while providing an inexpensive and quick method to repair imminemt corrosion problems.

SUMMARY OF THE INVENTION

Very briefly, the subject of the invention concerns a high amperage electrical switching apparatus which is especially adapted for use in a corrosive atmosphere. More particularly it concerns an electrical switching apparatus comprising multiple spaced apart stationary first terminals, each in interruptable circuit communication with corresponding multiple, spaced apart, stationary secondary terminals, said communication being by movable knife type circuit interrupting means pivotably attached to each second terminal that it will contact the corresponding first terminal at some point in the pivot arc, the improvement comprising, removably and conductively attaching to at least one stationary first terminal, at least one primary sacrificial bimetallic contact, having a highly conductive lower attachment section and a highly resistant contact tip, removably and conductively attached to at least one corresponding movable circuit interrupting means, at least one secondary sacrificial bimetallic contact, being comprised of multiple laminate highly conductive metal fingers backed by a spring compression laminate, having a highly resistant metal tip, said primary and secondary sacrificial bimetallic contacts being so attached to said first terminal and interrupting means that, under high amperage, when closing said switch, contact is made between the resistant tips of said primary and secondary sacrificial contacts prior to the initiation of arcing between the first terminal and movable interrupting means, contact between the sacrificial contacts being maintained throughout the closing of the switch and when opening said switch, contact is maintained between the primary and secondary sacrificial contacts until the interrupting means is so far removed from the first terminal that arcing therebetween may not occur. Further provision is made therein for gun drilled cooling channels throughout the conductive members, with manifold distribution of coolant therethrough.

DESCRIPTION OF THE PREFERRED EMBODIMENTS OF THE INVENTION

Figure 1:
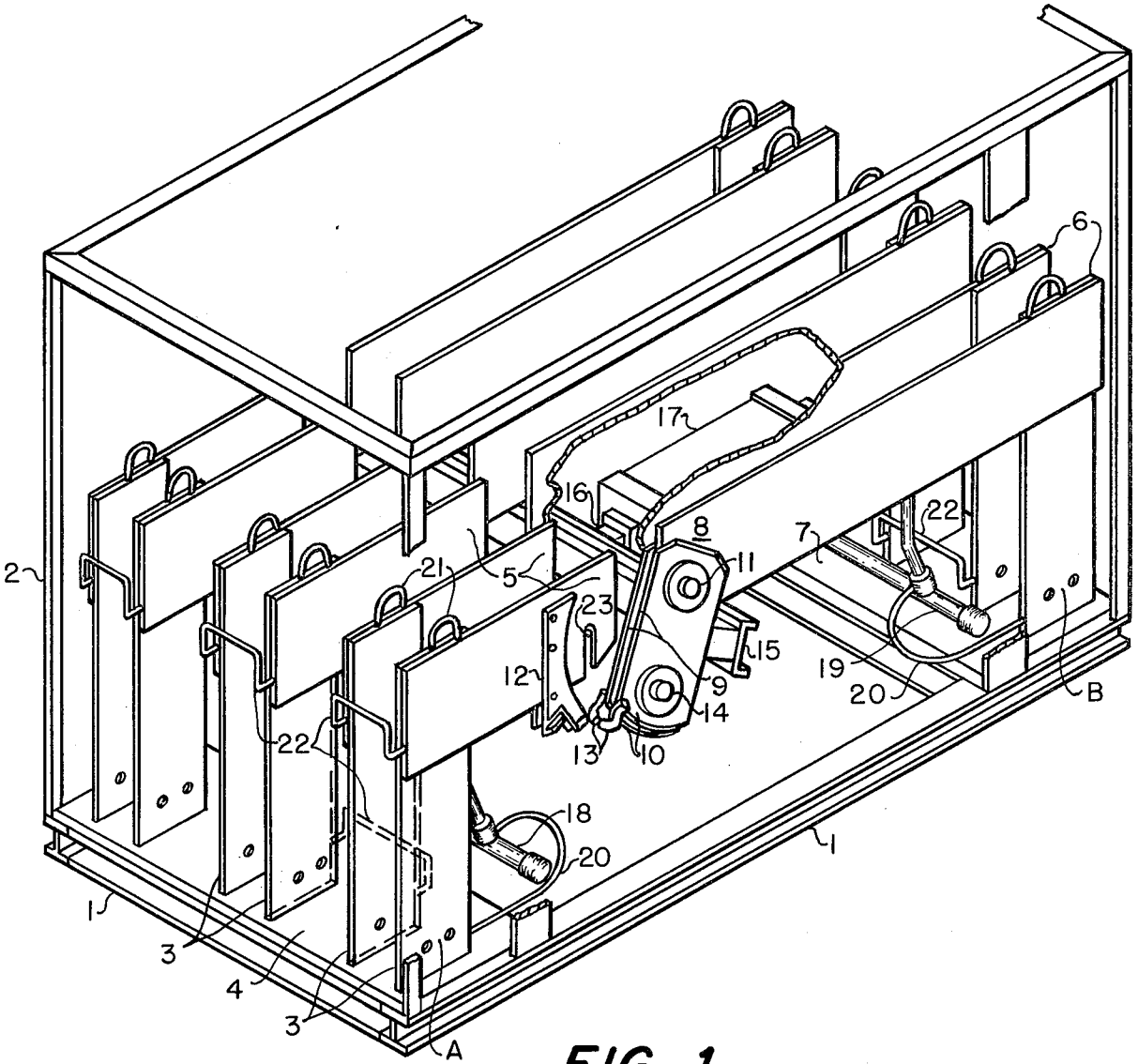
FIG. 1 is an isometric view of one embodiment of the high amperage electrical switching apparatus of the invention.

The preferred embodiments of the invention can best be appreciated by referring to the drawings.

Figure 6:
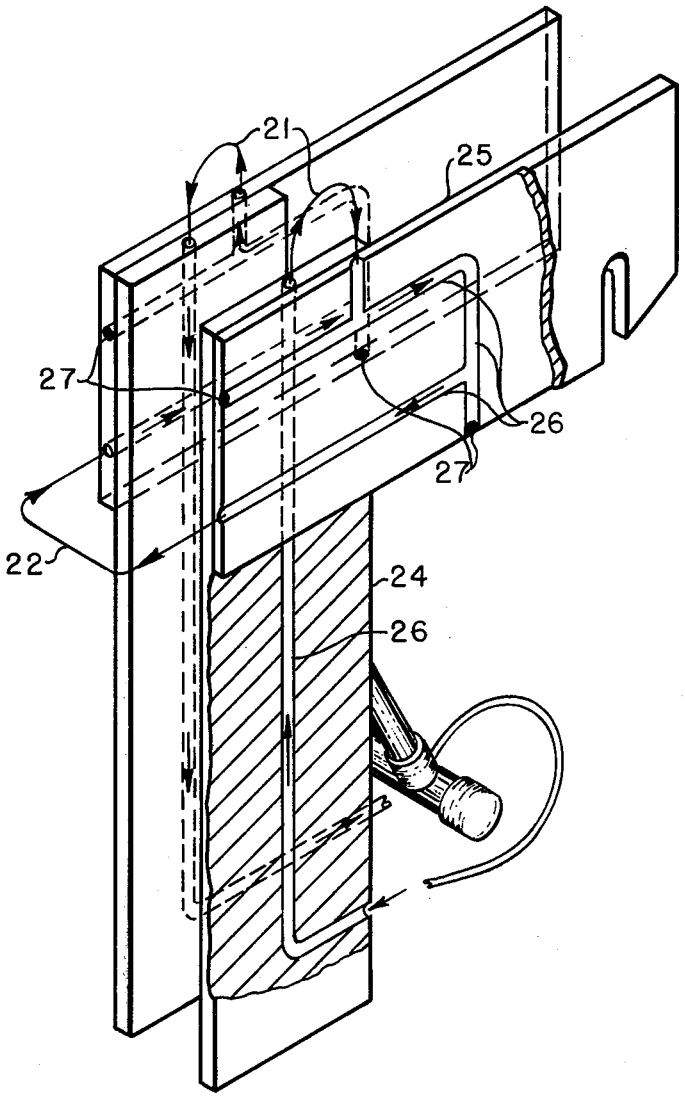
FIG. 6 is a sectional view of a first conducting member of FIG. 1 showing the coolant intake, outlet and circulatory system of the switching apparatus of FIG. 1.

Accordingly, referring now to FIG. 1 in particular, there is illustrated therein a switching apparatus comprising generally, a supporting base 1, housing frame 2, multiple stationary first conducting members 3, first conducting members non-conductive support 4, multiple stationary first terminals 5, multiple stationary second conducting members 6, second conducting members non-conductive support 7, multiple stationary second terminals 8, multiple interruptable conducting members 9, multiple interruptable terminals 10, interruptable contact pivot point 11, stationary primary arcing contacts 12, movable secondary arcing contacts 13, locking shaft 14, activating bar 15, activating piston 16, activating cylinder 17, coolant manifolds 18 and 19, manifold distribution tubes 20, coolant transport tube 21, coolant connector tubes 22, locking shaft receiver 23, and multiple power cable connecting points A and B. The apparatus is cable connected at multiple power cable connecting points A and B into the circuit in a manner to parallel shunt the electric current passing through the cell line through the less resistant switching apparatus. The interruptable conducting members of FIG. 1 are provided in pairs, contacting outside faces of each of the multiple first and second terminals. For simplicity only one pair of interruptable conducting members are shown in FIG. 1. The multiple interruptable paired conducting members may be pivotable attached at point 11 by means of individual or a common pivot cam. The locking shaft 14 may also be common or individual between the multiple conducting members. Outward movement of activating piston 16, transmitted through activating bar 15, causes rotation of the paired multiple interruptable conducting members 9 on the pivot cam (cams) and engages the multiple interruptable terminals 10 with the multiple stationary terminals 5 such that the locking shaft 14 (shafts) is received by the locking shaft receiver 23. A preferred embodiment is that the locking shaft 14 and more preferably both the locking shaft and the pivot cam be so constructed that upon the interruptable conducting members reaching the extent of their rotational movement, the pivot cam and locking shaft will rotate on their axis and this rotation will cause compression of each paired set of interruptable conducting members on the opposing faces of the stationary second terminals 8 and stationary first terminals 5, creating a positive pressure lock. The paired interruptable conducting members may be compression loaded therebetween to facilitate unlocking when opening the switch. Manifolds 18 and 19 provide distribution of coolant to the multiple first and second conducting members, through manifold distribution tubes 20. It is pointed out that manifold outlet distribution is to conducting members in series. FIG. 6 shows a more detailed description of the coolant flow through two first conducting members, which is similar to that of equivalent second conducting members. Therein each first conducting member is shown as being comprised of two flat conductive bars 24 and 25 being attached in overlap at right angles. Each conductive bar has been gun drilled as shown to create interconnecting coolant channels 26 therein. It is important that the conductive bars have internal coolant passages. Gun drilling is a preferred method of formation, however any convenient method, such as casting etc. may be used to form them. Coolant flow between the bars is by coolant transport tubes 21. Gun drilling ports 27 are blocked and connection between paired first conducting members is by coolant connection tubes 22. Such connection allows unrestricted coolant flow through all first conductive members at a time, thereby providing better heat transfer. The conductive bars of the primary and secondary conductive members should be composed of a highly conductive material or mixtures or alloys thereof. Copper and alloys thereof are especially preferred and it is within the scope of this invention that the terminals of said primary and secondary conductive members may be plated or otherwise composed of conductive materials, including mixtures and alloys thereof, which are different than that of the body of the conductive members. Further, the terminals may be contextural with the body of the conductive members or may be separate and attached thereto by any convenient method.

Figure 5:
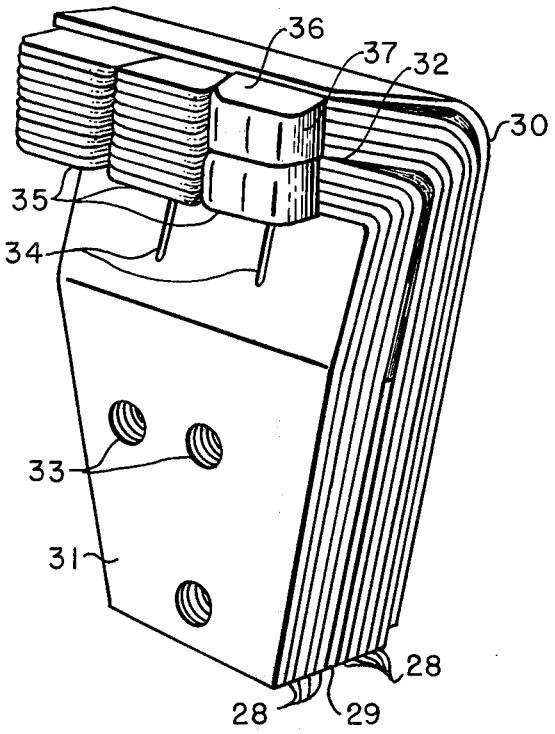
FIG. 5 is a further isometric view of the secondary sacrificial bimetallic contact of FIG. 3.

FIG. 5 illustrates a movable secondary arcing contact, being composed of a multiple metal laminate body 28, separated by tension laminates 29, backed by a spring compression laminate 30 with attachment section 31 and contact section 32. The attachment section is provided with holes 33 for easily removable attachment to the interruptable conducting member. The contact section is slotted 34 to comprise multiple contact fingers 35 which provide improved circuit contact by reducing stutter jumping of the movable contact while sliding along the surface of the stationary contact, during operation of the switch. The tip of at least one contacting finger surface, preferably that finger making initial contact with the stationary arcing contact in the closing operation, is composed of a resistant metal. The multiple laminate body may be composed of any highly conductive metal including mixtures and alloys thereof. Preferred metals include copper/silver and copper/berrilium alloys. It is also preferred that these laminates be resistant to annealing and flex fatigue. The tension and spring compression laminates may be comprised of any suitable material, conductive of non-conductive. The spring compression laminate should be composed of a material especially resistant to flex fatigue and high temperature annealing. It is preferred that the spring compression laminate be composed of a spring steel or like suitable metal. The highly resistant tip may be soldered, brazed, welded, plated or otherwise attached to one or more of the fingers of the movable secondary arcing contact. It should be highly resistant to pitting, welding and other deterioration caused by the arcing temperatures at which it will be subjected. Preferred highly resistant tip materials include tungsten and its alloys such as copper/tungsten and silver tungsten.

It is also preferred that the fingers making initial contact with the stationary arcing contact be beveled at the contact point to allow smooth operation of the switch. FIG. 5 illustrates a resistant metal tip 36 on an initial contacting finger with bevel 37.

Figure 3:
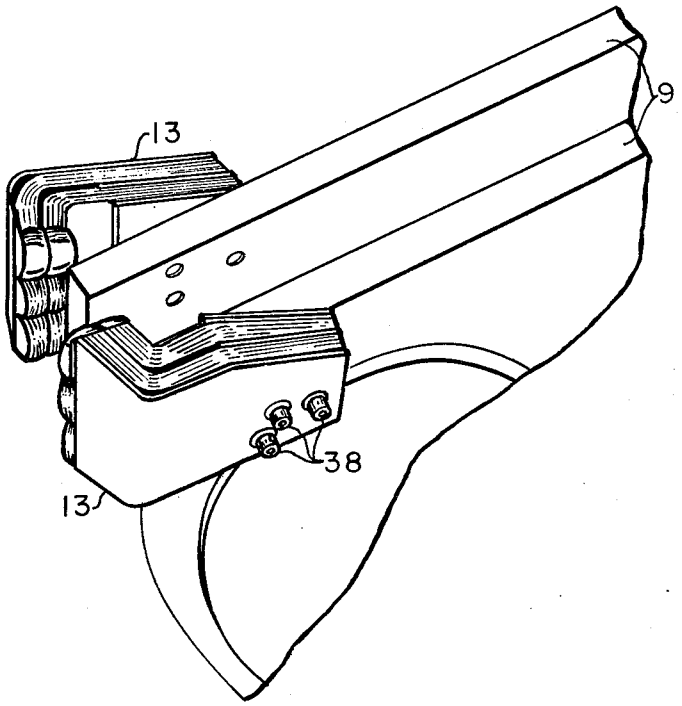
FIG. 3 is an isometric view of the contacting end of a movable interrupting means having attached thereto secondary sacrificial bimetallic contacts.

FIG. 3 illustrates the attachment of dual movable arcing contacts 13 to paired interruptable conducting members 9 by screw attachment 38. The attachment of such contacts can be by any convenient means, however, it is preferred that they be easily removable for convenient replacement. The movable arcing contacts are attached in such manner to the interruptable conducting member that contact, by at least the resistant tip thereof, with the stationary arcing contact is made prior to the initiation of arcing between the interruptable terminals 10 and the stationary first terminals 5. It is important that each movable arcing contact have a spring compression laminate backing as the heat intensity of the arcing current may quickly cause annealing of the conductive laminates resulting in poor contact. It is also important that the initial contact point of said movable arcing contact be tipped or otherwise composed of a resistant metal to avoid disintegration of the contact in operation. It is pointed out that though FIG. 3 illustrates arcing contacts on each of the paired interruptable conducting members (FIG. 2 illustrating two corresponding stationary arcing contacts), further embodiments include having only one movable (and one corresponding stationary arcing contact) to a set of paired interruptable conducting members.

Figure 2:
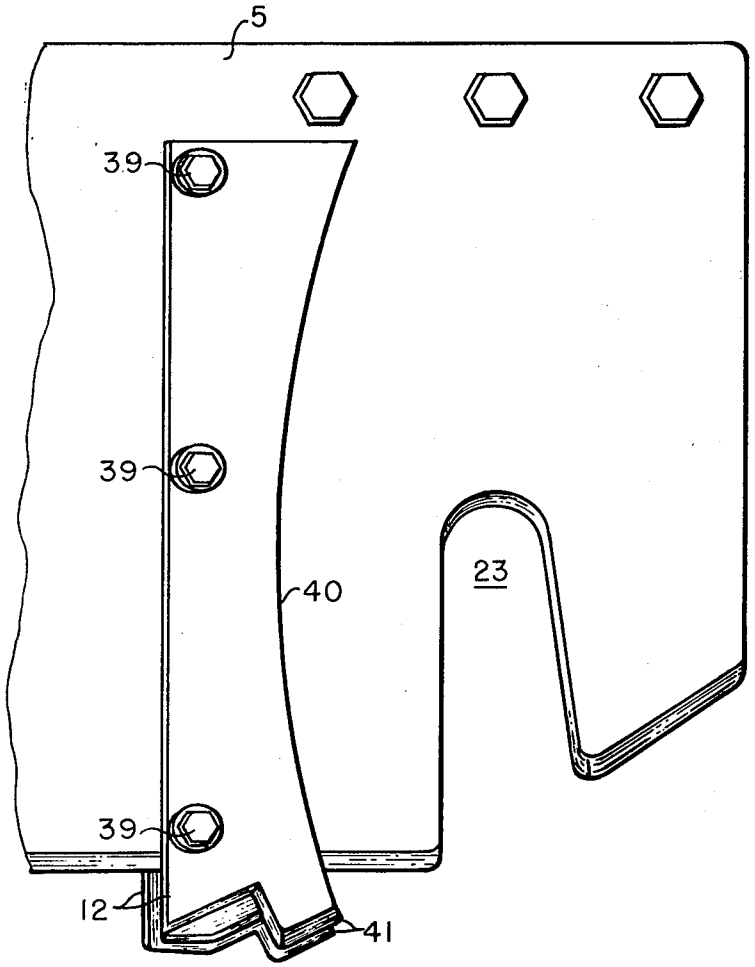
FIG. 2 is an isometric view of a stationary first terminal having attached thereto one embodiment of a primary sacrificial bimetallic contact.

FIG. 2 shows one embodiment of dual stationary arcing contacts 12 attached to a stationary first terminal 5, the locking shaft receiver 23 and attaching bolts 39. The body of the contact 40 should be composed of a highly conductive metal, the tip 41 of a resistant metal beveled to accept the resistant tip of the movable arcing contact. Initial contact of the movable arcing contact resistant tip should be with the resistant tip of the stationary arcing contact and contact between the movable and stationary arcing contacts should continue throughout the closing of the switch. As can be seen through a comparison of the working relationship between FIG. 2 and FIG. 3, as the interruptable conducting member pivots upward toward the first stationary terminal, the highly resistant, beveled tips of the movable arcing contact, contact the beveled highly resistant tips of the stationary arcing contact, and are gradually forced apart to ride, with pressure maintained by the spring compression lamination, on the outer surface of the stationary arcing contact through closing of the switch.

Figure 4:
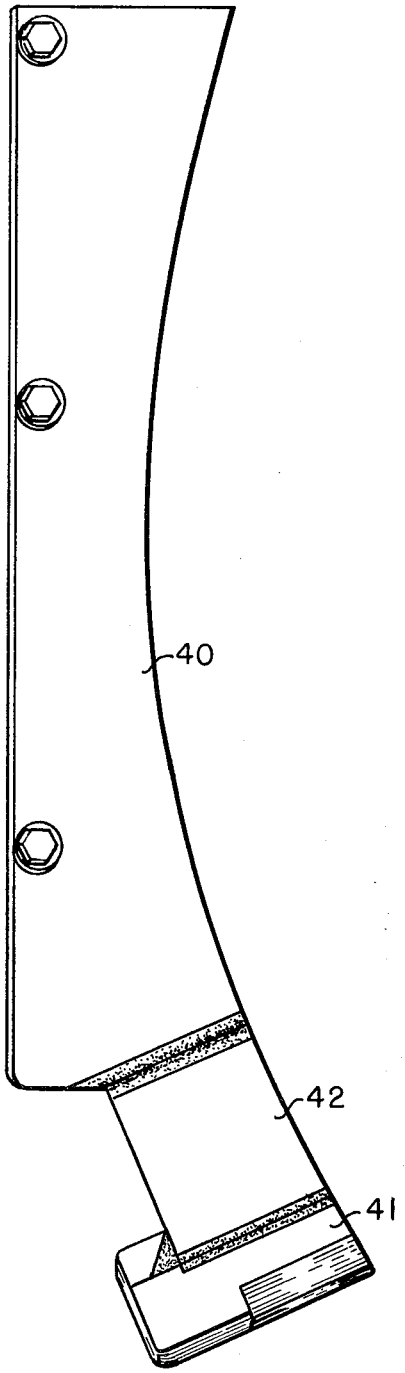
FIG. 4 is an isometric view of an embodiment of a primary sacrificial bimetallic contact.

FIG. 4 embodies an improved stationary arcing contact wherein the body 40 is comprised of a highly conductive metal, having an initial activating surface comprising a highly resistant tip 41 and an initial contact surface 42. The initial contact surface is comprised of a metal which is less resistant than the resistant tip and less conductive than the conductive metal of the body. The placement of such less conductive metal surface between the highly resistant tip and the highly conductive body allows a gradual decreased flow of current through the switch when opening, which significantly reduces arcing and accordingly prolongs the life of the sacrificial arcing contacts. The attachment section or body of either embodiment of the primary stationary arcing contact should be made of a highly conductive material, mixture or alloys thereof which has some resistance to the surface scraping occurring on contact with the movable arcing contact. It may be surface plated or otherwise surface prepared for better resistance to such scraping. It is preferred that it be composed of full hard copper. The resistant tip of either embodiment may be attached as provided for the movable arcing contact and should be composed of similar materials.

Since numerous changes may be made in the above-described apparatus and different embodiments of the invention may be made without departing from the spirit and scope thereof, it is intended that all matter contained in the foregoing description, or shown in the accompanying drawing shall be interpreted as illustation and not in a limiting sense.

We claim:

1. In a high amperage switching apparatus comprising multiple, spaced apart, stationary first terminals, each in interruptable circuit communication with corresponding multiple, spaced apart, stationary second terminals, said communication being by movable knife type circuit interrupting means pivotably attached to each second terminal such that it will contact the corresponding first terminal at some point in the pivot arc, the improvement comprising removably and conductively attaching to at least one stationary first terminal, at least one primary sacrificial, bimetallic contact, having a highly conductive lower attachment section and a highly resistant contact tip and removably and conductively attaching to at least one corresponding movable circuit interrupting means at least one secondary sacrificial bimetallic contact, said secondary sacrificial bimetallic contact comprised of multiple copper/silver laminates, separated by at least one tension laminate, backed by a spring compression laminate, the copper/silver laminate being slotted to comprise multiple contact fingers, and having a highly resistant metal tip, said primary and secondary sacrificial bimetallic contacts being so attached to said first terminal and interrupting means that under high amperage current, when closing said switch, contact is made between the resistant tips of said primary and secondary sacrificial contacts prior to the initiation of arcing between the first terminal and the movable interrupting means, contact between the sacrificial contacts being maintained throughout the closing of the switch and when opening said switch, contact is maintained between the primary and secondary sacrificial contacts until the interrupting means is so far removed from the first terminal that arcing therebetween may not occur.

2. The improvement of claim 1 wherein at least one contact finger has attached thereto a high resistant tungsten or tungsten alloy tip.

3. The improvement of claim 1 wherein said primary sacrificial bimetallic contact is comprised of a full hard copper attachment section and a high resistant tungsten or tungsten alloy tip.

4. The improvement of claim 1 wherein the resistant tips of said primary and secondary bimetallic contacts are beveled.

5. The improvement of claim 1 wherein said primary sacrificial bimetallic contact is comprised of a highly conductive attachment section, a highly resistant tip separated by an initial contact surface which is less resistant than said tip and less conductive than said attachment section.

6. A high amperage electrical switching apparatus adapted for use in a corrosive atmosphere comprising:

a. A housing;

b. Stationary multiple first and corresponding second conducting member, having terminals thereon, each of said conducting members having internal passage ways therethrough, through which cooling media flows;

c. Multiple movable conducting members each in pivotal attachment to a second conducting member terminal and each in interruptable circuit communication with a terminal of a corresponding first conducting member;

d. Stationary bimetallic contacts, attached to at least one of said first conducting members;

e. Movable bimetallic contacts, comprised of multiple copper/silver laminates, separated by at least one tension laminate, backed by a spring compression laminate, the copper/silver laminate being slotted to comprise multiple contact fingers, attached to at least one movable conducting member, in corresponding interruptable circuit communication with a first conducting member having a stationary bimetallic contact attached thereto, said movable contacts being so positioned that when opening said switch, contact is maintained between said movable and stationary contacts until the movable conducting member is so far removed from the terminal of the first stationary conducting member that arcing therebetween may not occur.

7. The apparatus of claim 6 wherein at least one contact finger has attached thereto a high resistant tungsten or tungsten alloy tip.

8. The apparatus of claim 6 wherein said stationary bimetallic contact is comprised of a full hard copper attachment section and a high resistant tungsten or tungsten alloy tip.

9. The apparatus of claim 8 wherein the resistant tips of said movable and stationary bimetallic contact are beveled.

10. The apparatus of claim 9 wherein said stationary bimetallic contact is comprised of a highly conductive attachment section and a highly resistant tip separated by an initial contact surface which is less resistant than said tip and less conductive than said attachment section.

* * * * *